United States Patent [19]

Lehman

[11] Patent Number: 4,569,555

[45] Date of Patent: Feb. 11, 1986

[54] TABLE STRUCTURE

[76] Inventor: James F. Lehman, 919 Fulton St., South Elgin, Ill. 60177

[21] Appl. No.: 675,995

[22] Filed: Nov. 29, 1984

[51] Int. Cl.[4] ..... A47B 83/02

[52] U.S. Cl. ..... 297/141; 297/157; 108/159

[58] Field of Search ..... 297/157, 158, 159, 141, 297/140; 108/99, 159

[56] References Cited

U.S. PATENT DOCUMENTS

| | | | |
|---|---|---|---|
| 210,187 | 11/1878 | Converse | 108/159 X |
| 822,182 | 5/1906 | Cassel | 297/141 |
| 1,094,227 | 4/1914 | Lotz | 108/159 |
| 3,120,405 | 2/1964 | Soszynski | 108/159 |
| 3,475,053 | 10/1969 | Parker et al. | 297/157 |
| 3,544,052 | 5/1969 | Conklin | 297/157 |
| 3,688,707 | 9/1972 | White | 108/159 |
| 4,031,831 | 6/1977 | Davis | 108/159 |

*Primary Examiner*—Francis K. Zugel

*Attorney, Agent, or Firm*—Lester N. Arnold

[57] ABSTRACT

An improved table structure includes a seating assembly having pivotably mounted elongated extension arms movable between a folded position and a extended position, table support structure providing flat upper surface area upon which to support table top means, the support structure including leg members which are supported to extend upwardly in a converging pattern to provide a wider base area as compared to the upper area enclosed by the leg members, the support structure having upper pairs of brace members which enclose and support the upper portions of the leg members against movement, and the extension arms of the seating assembly enclose and support the lower portions of the leg members against movement.

17 Claims, 14 Drawing Figures

FIG. 3
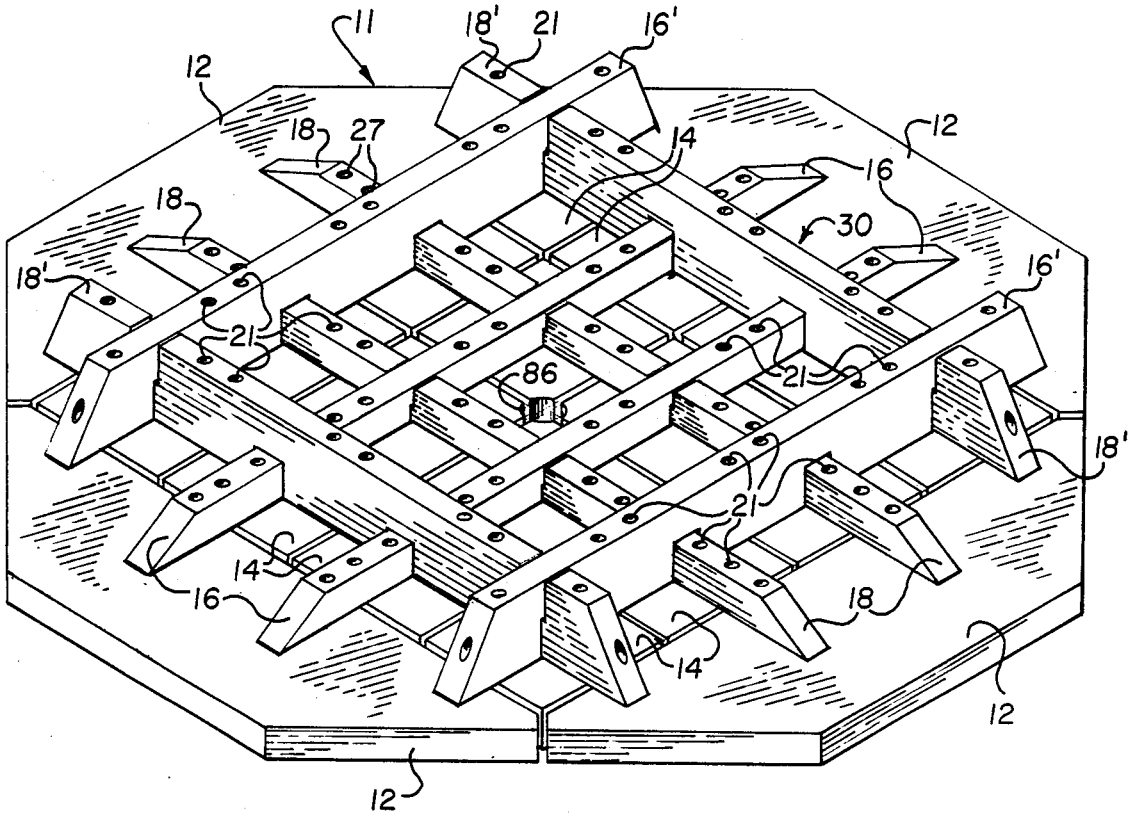
FIG. 7a
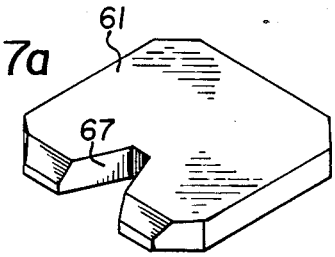
FIG. 7b
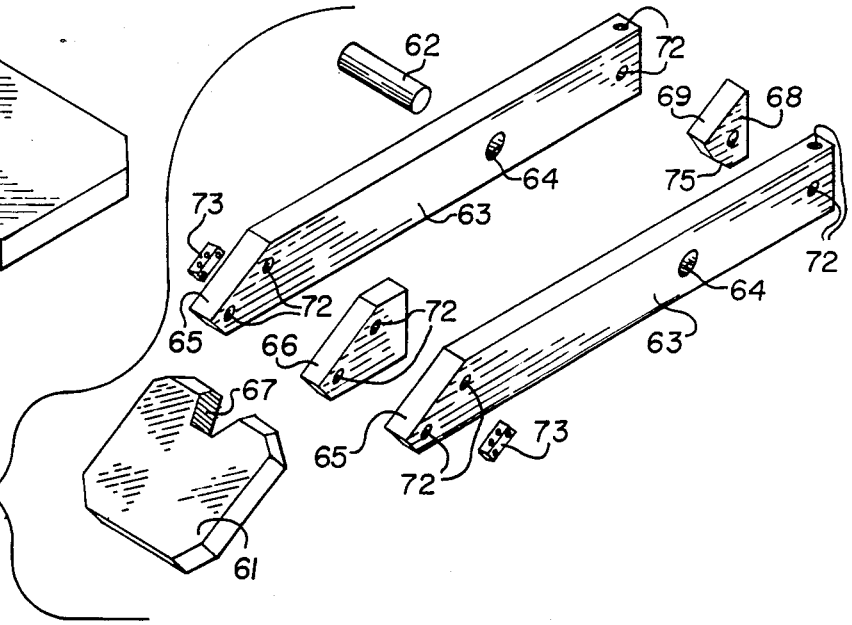
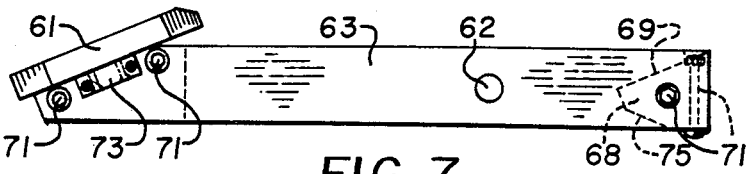
FIG. 7

TABLE STRUCTURE

BACKGROUND OF THE INVENTION

This invention relates to an improved table structure, and more particularly, to a table assembly having novel seating assembly with folding feature, stablized table support structure and improved table top grid means.

Table structures in the field of the invention are more commonly used for outdoor recreational purposes, and sometimes referred to as picnic tables. Such table structures are of many variations and sizes, and most often have table support structures presenting table top members suspended from four legs braced together by cross-support members and separate bench means or bench means built to be supported by and extending from the cross-support members of the table support structure. Outdoor usage of these recreational table structures dictates that the table top be capable of draining itself to prevent holding of water, and a common method of accomplishing such draining is to provide a table top structure having separated boards defining openings through the table top member. However, a disadvantage of providing separated boards is to then provide a level and coplanar table top structure. Further, the larger the openings used for drainage, the less surface is available for the table top; therefore, the openings are sought to be well placed and not as large in dimension in order to provide a maximum table top surface.

The underlying table support structure is often large and bulky, with sometimes more cross-support members than are needed, providing a table support structure of lessened economic utility, heaviness to deter mobility, and more often than not, is permanently attached to the table top structure or made an integral part thereof, which deters from mobility, disassembly and storage thereof. Most prior art table assemblies have support structures which are unstable or have a certain amount of swaying movement caused by inadequate bracing. It is an advantage to be able to remove the table top structure from the underlying table top support structure for facilitating storage of the entire table assembly. It is another advantage to provide a well designed support structure having adequate bracing, little or no sway movement, judicious number of parts eliminating a bulky structure.

Seating means are often comprised of separable bench members or chair members which are disadvantageous if lost, stolen or broken, and some improvement is realized from providing that the seating means are extended from and attached to the table support structure. However, such extended seating means are usually immobile, non-foldable and detract from the storage facility of the seating means and the table structure. Further, weight bearing on one side of the table structure as placed on extended seating means absent counterbalancing weight placed on the oppositely disposed seating means, may cause instability to the entire table structure. The separate seating means does not cause such problems, but creates other problems as discussed above, which leads one to utilize attached seating means having improved stability during weight bearing and being foldable to facilitate storage of the table support structure.

IN SUMMARY

It is an object of the present invention to provide an improved table structure having stable and foldable seating means, stable cross-support structure having utility of parts, and improved table top means with adequate drain openings and level coplanar top members.

It is an object of the invention to provide a table top structure including a plurality of rectangular shaped block members arranged in separated and grid placement interiorly positioned with respect to the outer confines of the table top structure.

It is another object of the invention to provide that all of the separated block members for the table top structure are supported by underlying grid lattice support means to lie in the same plane and present a level coplanar table top assembly.

It is still another object of the present invention to provide that the table top structure is removable in one piece from the underlying table top support structure.

It is yet another object of the invention to provide a table top support structure having a minimum number of cross-support brace members to support and brace the legs of the table assembly.

It is a further object of the present invention to provide a table top support structure having a minimum amount of or no significant sway movement.

It is still a further object of the invention to provide a table top support structure forming stable support means from which to extend foldable and attachable seating means.

It is yet a further object of the present invention to provide foldable and attachable seating means which when folded facilitate storage and provide less occupied space for the table assembly, and when extended comprise stable seating means.

It is still yet another object of the invention to provide that the table top support structure shall engage vertically supported pole means without permitting the pole means to contact the underlying supporting substrate for the table assembly.

It is an additional object of the invention to provide a table structure comprised of component parts which permit the economy of replacement of component parts without replacement of the entire table structure.

An improved table structure comprised in combination of: table top means including in assembly first brace members spaced apart in parallel, second brace members spaced apart in parallel and extending perpendicularly to the first brace members, selected portions of the first and second brace members having top surface portions thereof which are coplanar, respectively, peripheral top members and inner top members being selectively attachable to the top surface portions of the first brace members and second brace members, and providing top surface portions thereof which are coplanar, respectively, leg members extending upwardly and providing quadrantly spaced support for the table top means, table top support structure including in assembly first support members spaced apart in parallel, second support members spaced apart in parallel and extending perpendicularly to the first support members, selected portions of the first and second support members having top portions thereof which are coplanar, respectively, and upon which rest the table top means, first lower cross-support member extending between and attachable to an oppositely disposed pair of leg members, and second lower cross-support member extending between and attachable to other oppositely disposed pair of leg members, the first and second lower cross-support members having top portions thereof which are coplanar, respectively, pivotable seating means attachable to each of the leg members and being attached at a center point of the leg member located at the intersection of a center line extended from the attaching one of the first and second lower cross-support members, respectively, the seating means including parallel spaced extension members which enclose the leg member therebetween, and which embrace therebetween both the leg member and the attaching one of the first and second lower cross-support members with the seating means in a extended non-folded position with respect to the table support structure, and said extension members principally embracing the leg member to which the attachment is provided with the seating means in a folded non-extended position with respect to the table support structure.

Other objects and advantages of this invention will become apparent from consideration of the following detailed description, wherein reference is made to the accompanying drawing disclosing a preferred embodiment of the present invention.

DRAWING

FIG. 3 is a top perspective view of the table top structure when flipped over to show its underside and showing the lattice of cross-support brace members and their interlocking pattern with each other and interrelationship with the separate members of the table top assembly.

IFIG. 5 is an isolated perspective view of a selected portion of lower positioned cross-support brace members of the table top support structure showing the preferred attachment to a leg member fractionally shown.

Figure 6:
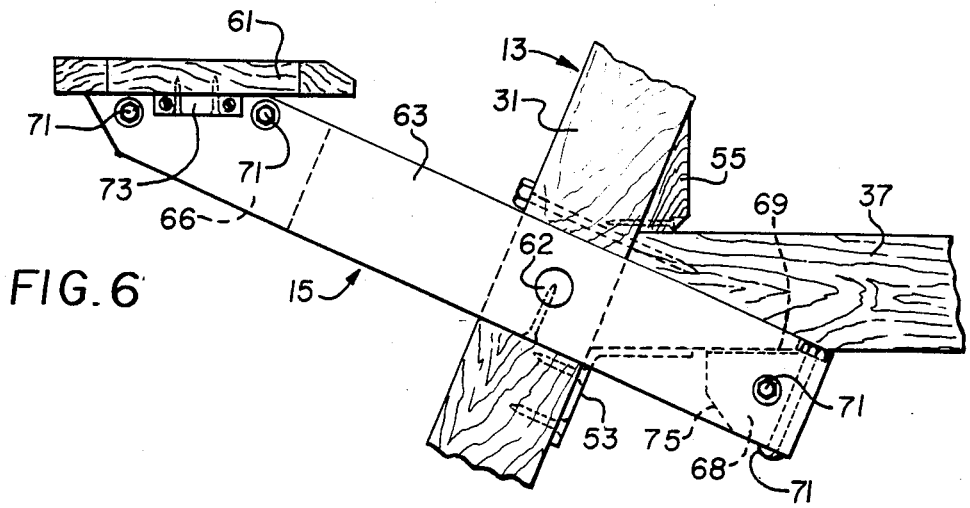

FIG. 6 is an fractional side view of a selected center portion of the leg member, showing pivotable seating means and its preferred pivoted attachment to the leg member, said pivotable seating means being shown in its fully extended position with respect to the leg member.

Figure 1:
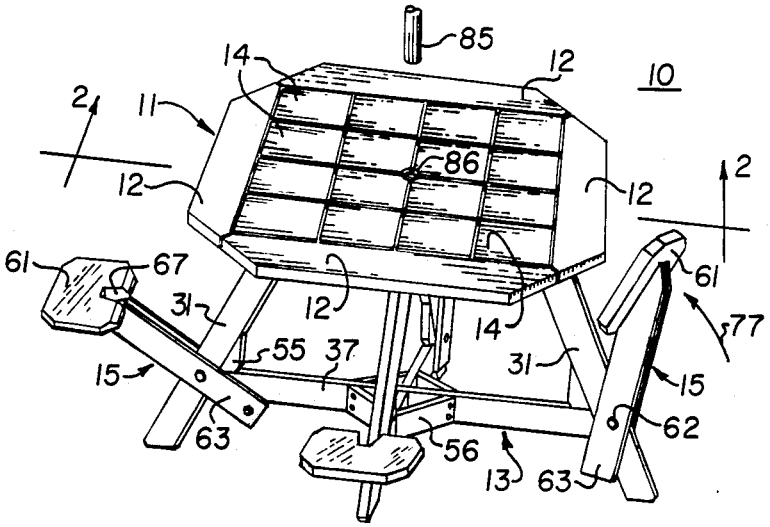
FIG. 1 is an overall perspective view of the improved table structure of the present invention, showing the seating means in alternative folded and extended positions.

FIG. 7 is a elevated side view of the seating means used with the preferred embodiment of the invention as shown in FIG. 1 and FIG. 6.

FIG. 7A is an isolated perspective view of the seat member of the seating means, showing the preferred contour and configuration thereof.

FIG. 7B is an exploded perspective view of the seating means of the invention, showing its contingent component parts.

Figure 8:
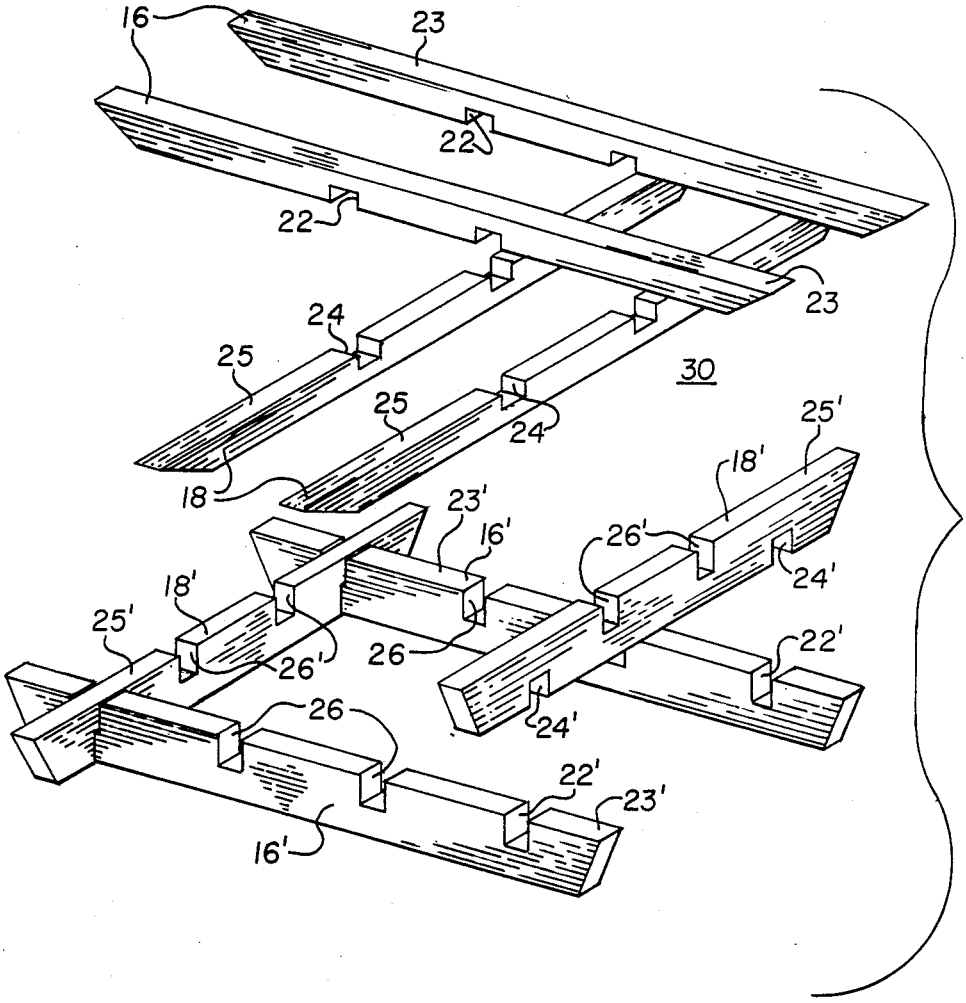

FIG. 8 is an exploded perspective view of the cross lattice of support members which form bracing means for the separable portions of the table top structure, and showing the interrelationship between the parts thereof.

Figure 9:
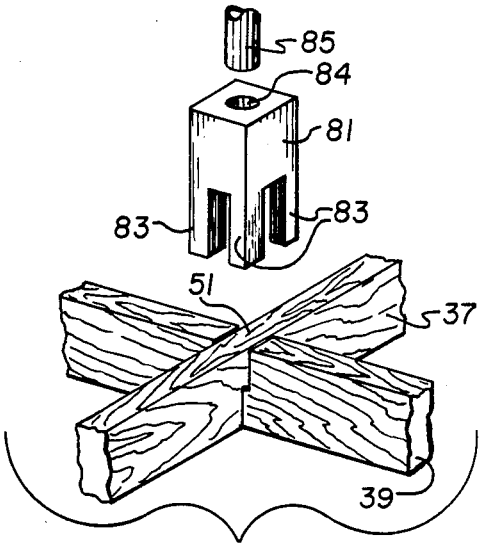

FIG. 9 is an isolated fractional exploded perspective view of a selected portion of the lower positioned cross-support brace members of the table top support structure, showing preferred pole holder means and pole fragment and their preferred engagement with the cross-support brace members at the point of intersection of the brace members.

Figure 10:
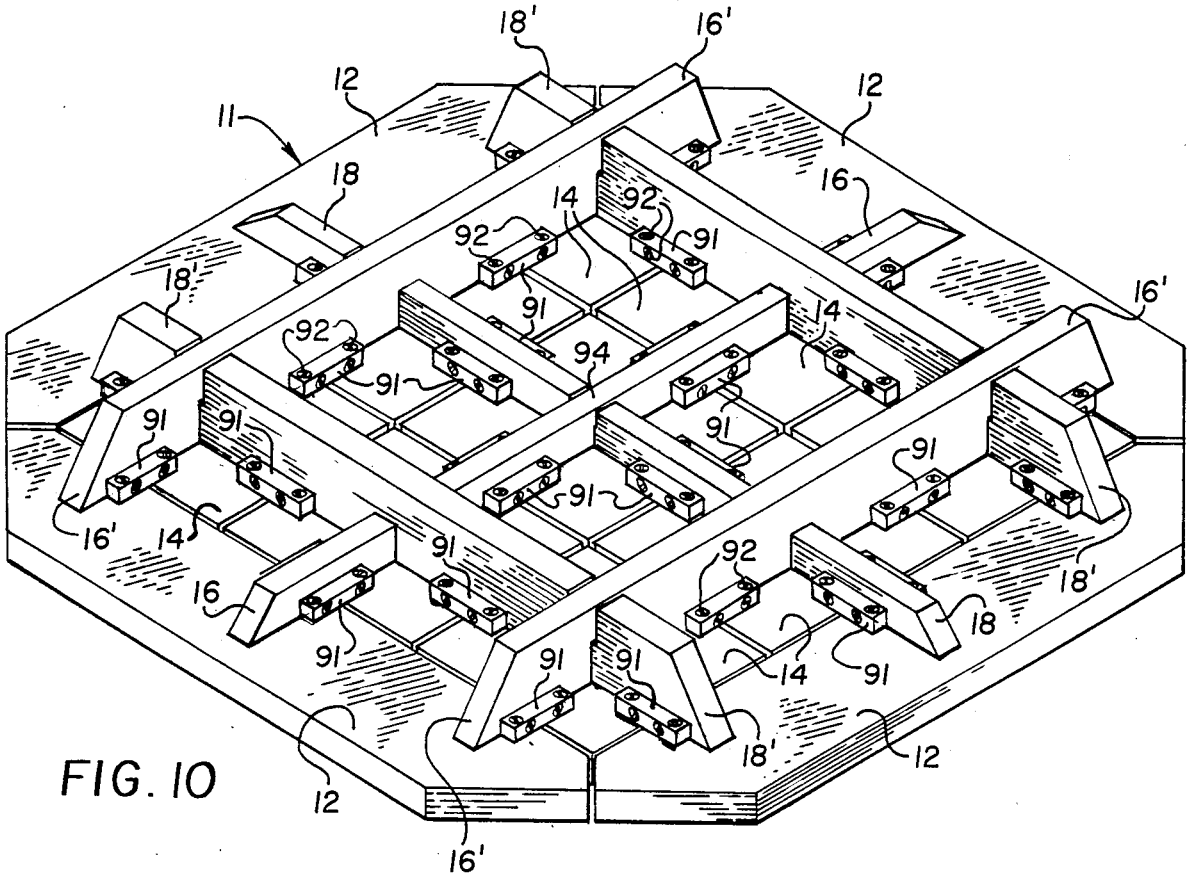

FIG. 10 is a top perspective view of the table top structure of the invention when flipped over to show the underside thereof, and showing an alternative embodiment of the lattice formation of cross-support brace members similar to the view shown in FIG. 3.

Figure 11:
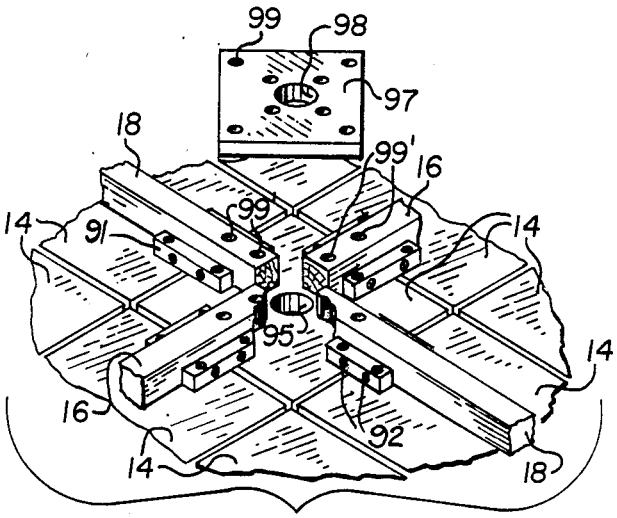

FIG. 11 is a fractional exploded underside perspective view of the center portion of the table top structure showing a preferred manner of providing a center opening to accommodate passage of pole means, and the manner of terminating the cross-support brace members near the center opening.

DETAILED DESCRIPTION

Figure 2:
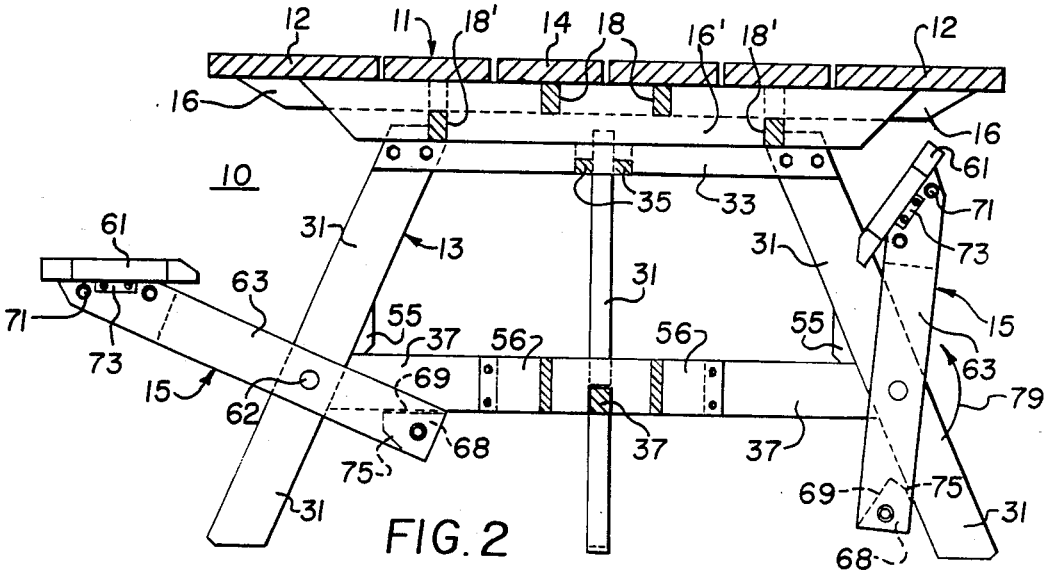
FIG. 2 is a partial sectional view of the table structure shown in FIG. 1, taken generally along the line 2—2 of FIG. 1 and showing the engagement between the table top and the underlying table top support structure.

There is shown in the accompanying drawing, and more particularly with reference to FIGS. 1 and 2 thereof, an improved table structure 10 including in combination table top means or structure 11, table top support means or structure 13, and seating means or structure 15. The table top means 11 includes outer peripheral top members 12 and separate inner top members 14 which are attached to underlying first brace means or members 16 and second brace means or members 18, which are better shown in FIG. 3. Additional first brace means 16' and second brace means 18' are also provided as shown in the drawing, and the peripheral top members 12 and separate inner top members 14 are attached thereto by suitable fastener means, such as screws indicated at 21 throughout the drawing.

FIG. 8 shows the preferred orientation of the several brace members 16, 16', 18 and 18', wherein a pair of the first brace members 16 are provided in parallel spaced-apart extension, and a pair of the second brace members 18 are also provided in parallel spaced-apart extension and oriented in a manner to extend perpendicularly with respect to the extension of the first brace members 16. Similarly, a pair of the brace members 16' are provided in parallel spaced extension, and a pair of the brace members 18' are provided in parallel spaced extension and oriented to extend in a perpendicular direction to the direction of extension of the pair of brace members 16'. The brace members 16' and 18' are shown to be of larger dimension as compared to the brace members 16 and 18, and are preferrably placed outside of the smaller sized brace members 16 and 18 to form the integrated frame-like grid or lattice structure as shown in FIG. 3.

The smaller brace members 16 and 18 are provided with notches or troughs 22 and 24, respectively, selectively spaced apart along the intermediate sections thereof, and the larger brace members 16' and 18' are provided with correspondingly placed notches 22' and 24', respectively, selectively spaced apart along the intermediate sections thereof. With reference to FIG. 8 and FIG. 3, there is demonstrated therein the manner in which the smaller brace members 16 and 18 are caused to be interconnected or interfaced together by merging the braces 16 and 18 at the locations of the notches 22 and 24, respectively. That is, the notches 22 receive therein the reduced portion of the brace member 18 disposed at the location of the notches 24, while simultaneously, the notches 24 receive therein the reduced portion of the brace member 16 disposed at the location of the notches 22. The larger brace members 16' and 18' are similarly interconnected by their fitting together at the locations of the notches 22' and 24'. Further, the larger brace members 16' and 18' are provided with a pair of notches 26 and 26', respectively, located intermediately thereof and which are intended to receive therein, the inserted smaller brace members 18 and 16, respectively.

Figure 3A:
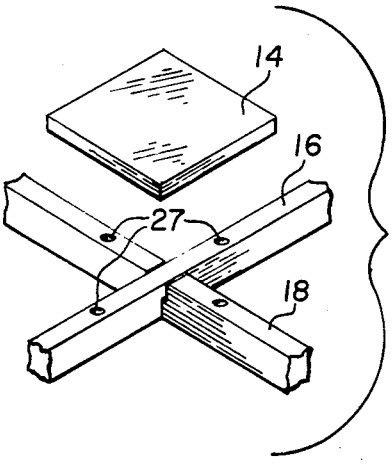
FIG. 3A is an isolated enlarged perspective view of a single block member forming the top portion of the table structure and the underlying intersection of cross-support brace members to which the top portion is attachable.

The brace members 16 and 18 when fitted together as shown in FIG. 3, present coplanar top surface portions 23 and 25, respectively, (FIG. 8) and the brace members 16' and 18' when fitted together as shown in FIG. 3, provide coplanar top surfaces 23' and 25', respectively. The interconnected frame-like grid of brace members as shown in FIG. 3 provides that the top surfaces 23-23' and 25-25' are all coplanar, and provide a level frame structure 30 upon which to attach the component members 12 and 14 of the table top structure 11. FIG. 3 shows the underside of the table top structure 11 with the integrated brace members 16-16' and 18-18' oriented with respect to each other, it being understood that the attached top members 12 and 14 and integrated brace members 16-16' and 18-18' comprise the completed table top structure 11. FIG. 3A discloses an individual inner top member 14 being mounted to the underlying brace members 16 and 18 and centered over a point of intersection therebetween. Suitable fasteners may be inserted through apertures 27 in the brace members 16 and 18 and driven into the underside thickness of the inner top members 14. The outer or peripheral top members 12 are to be attached to the end portions of the underlying brace members 16-16' and 18-18' by means of suitable fasteners 21 extended through receiving apertures 27, as is clearly shown in FIG. 3.

In a preferred embodiment for the table top structure 11, the outer top members 12 are generally elongated and are arranged in a rectangular frame-like pattern to define therebetween an inner or central opening within which a plurality of the inner top members 14 are placed to complete so-called table top surface means. The preferred surface configuration for the inner top members 14 is rectangular or square and the block-like configuration thereof is convenient for providing maximum surface area and attachment of the members 14 to the brace members 16-16' and 18-18' at the points of the intersection therebetween. It is readily seen that the block-shaped members 14 are separated from each other to define openings surrounding each of the block members 14. The size of the openings are a function of the size of the block members 14 and the separations thereof. However, so long as the openings are of adequate width to provide drainage therethrough of water or liquids and to prevent accumulations of food stuffs or dirt, the width of the openings are not critical to the essence of the present invention. It is a function of the present invention, however, to utilize the coplanar surfaces of the brace members 16-16' and 18-18' to provide that the top surfaces of the outer top members 12 and inner top members 14 are coplanar and level, and the locations of the members 14 are precisely centered over the points of intersection of the brace members 16-16' and 18-18' in order to provide uniform spacing of the members 14.

In accordance with the present invention, the table top structure 11 is supported by the table top support structure 13, but without attachment thereto. The support structure 13 includes in combination leg means or members 31, first or upper cross-support brace members 33 and 35 (FIG. 4), and second or lower cross-support brace members 37 and 39 (FIG. 5). The leg members 31 are conveniently located in a four quadrant placement pattern beneath the table top structure 11, and thereby provide for two pair of oppositely disposed leg members 31 with each pair being rotated 90 degrees with respect to the other pair of leg members 31. The leg members are extended upwardly in a converging direction, and at an angle of convergence of approximately 60° with reference to the horizontal so as to enclose a wider base area as compared to the upper area enclosed by the leg members, and thus provide stability to the assembled support structure 13.

Figure 4:
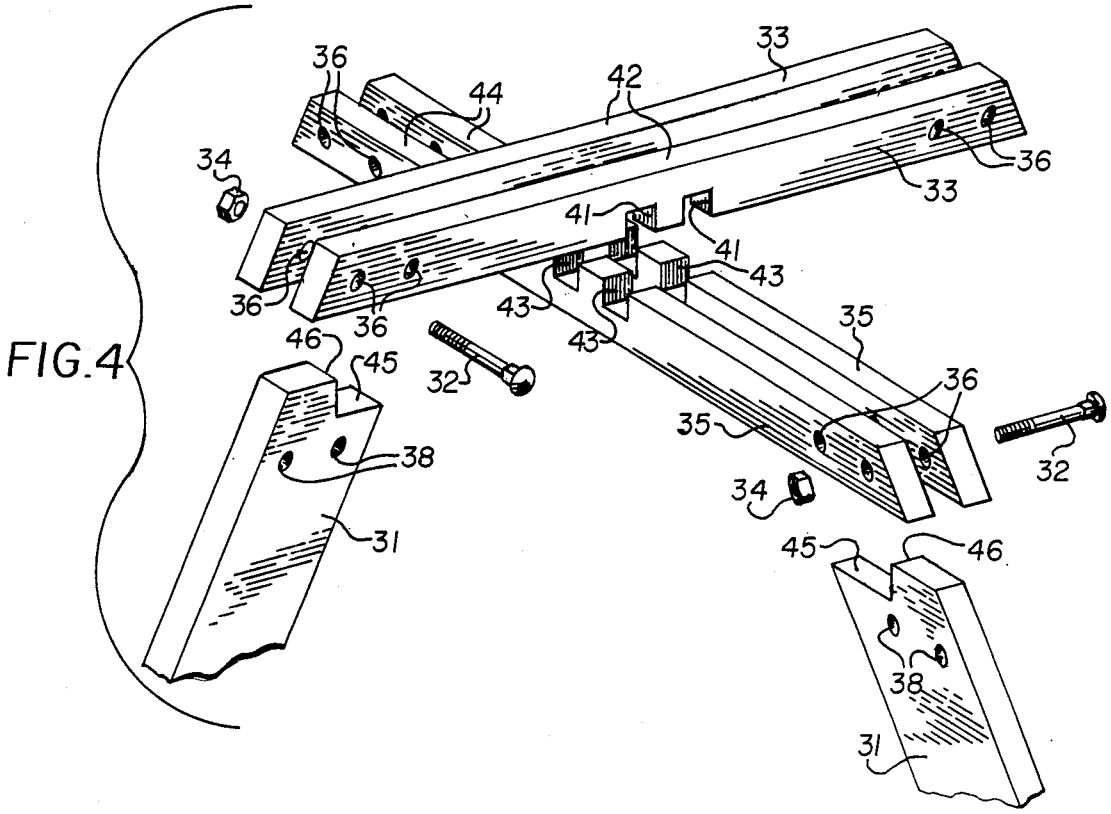
FIG. 4 is an isolated fractionally perspective view of a selected portion of the underlying table top support structure showing the attachment of leg members to upper cross-support brace members.
Figure 5:
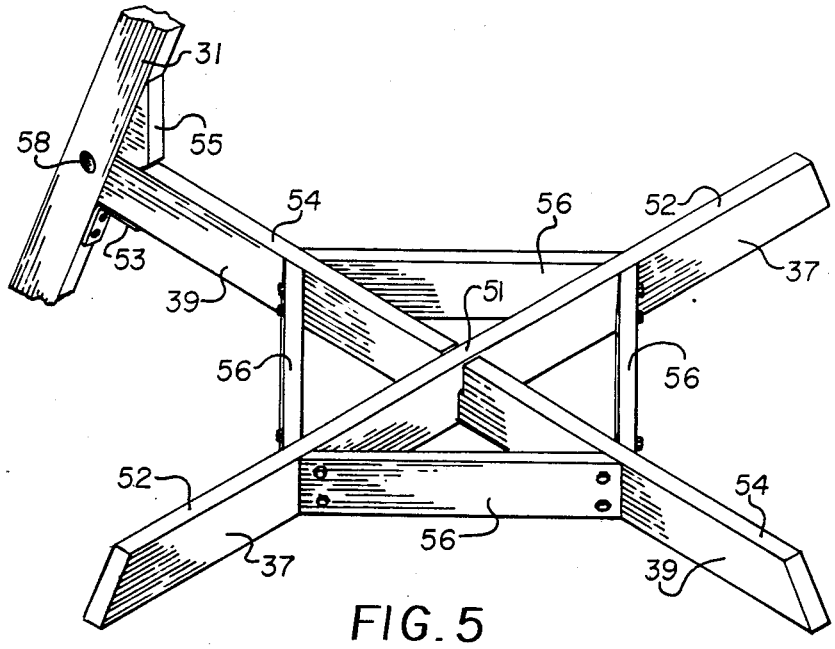

FIG. 4 shows a pair of upper cross-support brace members 33 spaced apart in parallel extension, and a pair of upper brace members 35 spaced apart in parallel extension. The opposite end portions of the gapped brace members 33 and 35 are to be joined on each side of the upper end portions of the oppositely disposed leg members 31, respectively. Thus, a leg member 31 is restrained from movement about its elongated axis, or twisting movement. Suitable fastener means such as threaded bolt 32 and receiving nut 34 are used wherein the bolt 32 is inserted through aligned apertures 36 in the upper brace members 33 and 35 and aligned apertures 38 in the leg members 31. The upper brace members 33 are provided with notches or channels 41 on the underside thereof disposed generally in the middle section thereof, and the perpendicularly extending upper brace members 35 are provided with notches or channels 43 on the topside thereof disposed generally in the middle section thereof. It is to be understood that the assembly of the brace members 33 and 35 provides that the notches 41 and 43 be aligned and the brace members 33 and 35 fitted together at the location of the channels 41 and 43, in the same manner as has been heretofore described for the assembly of the brace members 16-16' and 18-18' of the table top structure 11. It is to be noted that the inserted brace members 16-16' and 18-18' and support members 33 and 35 do not contain fastener means in the interfitted area of the notches.

The assembly of the upper brace members 33 and 35 provides that the upper surfaces 42 of the members 33 and the upper surfaces 44 of the members 35 are coplanar and provide stability and a level surface upon which to mount without attachment the table top structure 11. The upper end portions of the leg members 31 are cut away on the inner sides thereof to provide offset top surfaces, respectively, the lowermost and inner surface thereof being assigned the reference character 45, and the offset provides an upwardly extending shoulder surface 46. With the leg members 31 attached to the assembly of upper brace members 33 and 35 the upper and inner leg surface 45 is presented to lie in the same plane with, that is, being coplanar with, the top surfaces 42 and 44, respectively. The table top structure 11 is then placed at rest on the underlying support structure 13 with the outermost brace members 16' and 18' received upon the top surfaces 42, 44 and 45, while the shoulder surfaces 46 serve as outer stop surfaces to arrest any horizontal displacement of the table top structure 11. In the preferred assembly of parts for the table structure 10, the table top 11 is removable from the support structure 13 and is without means of fastening the table top 11 to the support structure 13. Of course, attachment between parts 11 and 13 could be readily provided if desired without effecting or altering the scope, spirit and function of the present invention.

FIG. 5 shows the lower cross-support brace members 37 and 39 wherein only a single brace 37 and a single brace 39 are employed. The lower braces 37 and 39 are suitably notched in the middle section thereof and interfitted together at the location of the notches (not numbered in FIG. 5) in the same manner as has been done and explained hereinbefore for upper support members 33 and 35. The braces 37 and 39 thus intersect at their mid-points at 51 in FIG. 5, and the upper surfaces 52 and 54 thereof, respectively, are coplanar and level with respect to each other. The purpose of the mid-point intersection of lower braces 37 and 39 shall be made more clear hereinafter in connection with the explanation of FIG. 9. Meanwhile, it is seen that the lower supports 37 and 39 are oriented edge down and the opposite end portions thereof intersect and abut the narrowed edge of the leg members 31 as shown in FIG. 5 in edge-to-edge fashion. The attachment of the lower supports 37 and 39 to the leg members 31 is conveniently provided by angle or corner brackets 53 and angle or corner braces 55. The brackets 53 and corner member 55 are attached by conventional fastener means, such as screws, and additional lug screws may be provided between leg member 31 and the abutting support members 37 and 39, as shown in FIG. 6. Obviously, other and equally suitable attachment means could be employed without effecting or altering the scope, spirit and function of the present invention. The middle and interfitted sections of the lower brace members 37 and 39 are reinforced against displacement or sway by provision of four angle or corner beams 56 which are angled between the cross braces 37 and 39 and attached thereto.

Further, in accordance with the present invention, the foldable and extendable seating means 15 is provided and includes seat apparatus 61 and a pair of parallel-spaced extension arm members 63 (see FIGS. 7, 7A and 7B). The seat apparatus 61 is suitably attached to the free end portion of the extension members 63, which arm members 63 are pivotably connected to a selected one of the leg members 31, and receive the leg member 31 between the parallel-spaced extension arms 63. The arms 63 are connected to the selected leg member 31 by means of inserting a pivot pin 62 through aligned apertures 64 in the arms 63, and an aligned aperture 58 in the leg member 31 (see FIG. 5). The extended or free end portions of the arms 63 are cut on a selected angle to provide angular end surfaces 65, respectively, which determine that the attached seat 61 is generally horizontal when the arms 63 are in a fully extended position with respect to the support structure 13. A center spacing block 66 is similarly configured and is attached between the angular end portions of the arms 63 for purpose of additional strength with which to support the seat 61 and its bearing weight forces.

On the opposite and inwardly placed ends of the extension arms 63, there is provided an arrest block or stop means 68 which is attached to and interleaved between the opposite end portions of the arms 63. The stop means 68 provides an angled surface 69 thereof which extends in a plane parallel to the plane of extension of the seat member 61, as well as the plane of extension of the surfaces 65 supporting the seat member 61. Suitable fastener means 71 are used to extend through aligned apertures 72 to provide the desired assembly of parts for the seating means 15. If desired, a pair of seat brace members 73 can be provided, each member 73 being attached to both the seat member 61 and the adjacent extension arm 63. The seat member 61 is clearly shown in FIGS. 7A and 7B, and is provided with selected dimensions of thickness, surface area and seating contour. More important to the essence of the invention, the seat member 61 is provided with a recessed channel 67 which is of sufficient width and depth to permit the reception therein of that portion of the outer edge of the leg member 31 which will come into contact with the seat member 61, when the seating means 15 is caused to be pivotably folded from its extended position for seating purposes (FIG. 6) to a non-extended folded position as shown in FIGS. 1 and 2. The directions of the arrows 77 in FIG. 1 and 79 in FIG. 2 demonstrate the direction of folding movement of the seating means 15 about the pivot pin 62. The receipt of the leg member 31 into the recessed channel 67 adds strength against lateral movement of the seating means 15 when in a fully folded position.

The stop member 68 is further provided with another angled surface 75 which is used to provide a stop surface to abut the inside edge of the leg member 31 when the seating means 15 is in its fully folded and retracted position beneath the table top structure 11. FIG. 2 shows the engagement between surface 75 and the leg member 31, and FIGS. 2 and 6 show the engagement between arrest surface 69 of the stop member 68 and the lower cross-support brace member 37. A principle of the invention is disclosed and taught in FIGS. 1–2 and FIG. 6 wherein when the seating means 15 is moved from a folded and non-extended position to a fully extended position with respect to the leg member 31, the parallel-spaced arms 63 are caused to engage therebetween an increasing area of the attached lower support member 37 at the point of attachment to the leg member 31.

It is important to note that it becomes increasingly more critical to support and reinforce the edge-wise intersection of the leg member 31 and the lower support member 37 (or 39) when the seating means 15 is in its extended position intended for weight bearing use. Tangential or lateral forces applied at the aforementioned intersection have less damaging effects with the extension arms 63 simultaneously enclosing a significant portion of the aforementioned intersection between the parts 31 to 37, or 31 to 39. When the seating means 15 is in its folded and retracted position, the extension arms 63 are virtually free from enclosing any significant portion of the lower cross-support braces 37 and 39. It has been determined that if the cross-support braces 37 and 39 are horizontal, the elongated axis of the extension arms 63 will extend upwardly at an approximate angle of $22\frac{1}{2}$ degrees from the horizontal for optimum support of the aforementioned intersection of parts 31 to 37, or 31 to 39. Some degree of variation may be utilized without loss of sufficient support for the aforementioned intersection, and the exact angle of upward extension of the arms 63 is not considered critical to the principle taught herein.

Now referring to FIG. 9, there is shown in enlargement the intersection 51 of the cross-support members 37 and 39 of FIG. 5. In accordance with another principle of the present invention, holder block means or member 81 is provided to be inserted over the edge portions of the members 37 and 39 at the point of their intersection at 51. To these ends and purposes, the holder member 81 is provided with four extending and corner positioned tines or fingers 83, three of which are shown in FIG. 9, which are readily seen to be received downwardly along the corners of the intersecting parts 37 and 39. The tines 83 are defined by perpendicularly intersecting openings or channels (not numbered in the drawing) which pass or extend through the holder block 81 in the same directions of extension as the support braces 37 and 39. The depth of the channels or length of the tines 83 are a matter of choice not critical to the principle of the invention except provided that the holder 81 is mounted in a stable manner upon the lower support braces 37 and 39. The holder 81 includes in the upper surface thereof, a centered aperture 84 into which the end portion of an upwardly extended pole member 85 (shown in fragment at 85 in FIG. 9), can be received for support.

It is still another principle of the present invention to provide improved pole support apparatus for the table structure 10, and to this end and purpose the table structure 11 of FIG. 1 is provided with a centered aperture 86 which extends through the thickness of the inner top members 14 as are located in the center portion of the table top structure 11. The pole 85 is of a standard type commonly used in traditional models of picnic tables to suspend an umbrella or other type cover means (not shown) above the table structure 10. The pole 85 is intended to be inserted through the aperture 86, to pass between the intersecting pairs of upper cross-support braces 33 and 35, at the center point of the intersection thereof, and to have its lower end portion insertedly received into the aperture 84 of the holder member 81. In this manner, the pole 85 is vertically supported without extending downwardly to engage the underlying substrate upon which the table structure 10 may be at rest, but a substantial length portion of the pole 85 is received below the table top structure 11, and when coupled with the holder member 81, the pole 85 and attached cover combination (not shown) are not top heavy and prone to be displaced. The full extension of the pole 85 to the underlying supporting substrate, such as the ground or floor, has had the negative effect of detracting from the mobility of the table structure 10. The aperture 86 in the table top 11 is also shown in FIG. 3 for illustration purposes.

FIG. 10 shows an alternative embodiment of the table top structure 11 as was shown and described in connection with FIG. 3, wherein only one of the brace members 16 and one of the perpendicularly extending brace members 18 is employed. The brace members 16' and 18' are unchanged over the disclosure made in connection with FIG. 3. The intersecting brace members 16 and 18 are provided with aligned notches 22 and 24 as was previously described in connection with FIG. 8, the notches 22 and 24 not being clearly shown in FIG. 10. The notches 22 and 24 are located at the point of intersection between the singular members 16 and 18, which point of intersection is in the approximate center of the table top structure 11. In this embodiment, the center pole holding aperture 86 is omitted, except provided that a modified embodiment is shown in FIG. 11 which employs the aperture 86.

It is clearly seen in FIG. 3 and FIG. 10, that the number of intersections between the brace members 16-16', 18-18' and 16-18 are fewer in number in FIG. 10 than in FIG. 3, and that the number of inner top members 14 that are used in both embodiments are equal in number to the numbers of points of intersection between the brace members 16-16', 18-18' and 16-18. This formula of determining the number of inner top members 14 used in the primary embodiment of FIG. 3 remains the same for the alternative embodiment. Lesser numbers of inner top members 14 could be used but not more in number to the number of points of intersection between the brace members 16-16', 18-18' and 16-18. Since the inner top members 14 of FIG. 10 are of larger size than the members 14 of FIG. 3, additional support or block means 91 are utilized in order to provide and assure level and coplanar position of the individual top members 14.

As shown in FIG. 10, the block means 91 are provided in pairs positioned on opposite sides of the brace members 16, 18, 16' and 18'. The block means 91 are attached by suitable fastening means such as screw-like fasteners shown at 92, to each the adjacently placed brace member 16, 18, 16' and 18' and attached to the underlying (with reference to FIG. 10) top members 12 and/or 14. The desired pattern of placement is shown in FIG. 10 wherein each of the inner top members 14 have a pair of blocks 91 attached thereto at approximately the mid-section of each of the four sides thereof, which pair of blocks 91 extend to be connected to adjacently placed top members 12 and/or 14. In this manner of attachment, the top members 12 and 14 do not require to be attached directly to the brace members 16, 18, 16' and 18' as was shown and described in connection with FIG. 3. This provides an alternative embodiment for mounting the top members 12 and 14 to the frame-like grid defined by the brace members 16, 18, 16' and 18'. It is obvious that either form of attachment of the top members 12 and 14 could be used in connection with the smaller top members 14 of FIG. 3 or the larger top members 14 of FIG. 10.

FIG. 11 shows a modification to the center point of intersection between brace members 16 and 18 as shown in FIG. 10, wherein the brace members 16 and 18 are terminated prior to the intersection thereof at the center point, indicated at 94 in FIG. 10. A center aperture 95 is provided in the centered top member 14 through which a pole member 85 could be inserted. A brace plate member 97 can be provided to strengthen the brace members 16 and 18 wherein their point of intersection at 94 was deleted. The plate 97 is provided with a center aperture 98 to be aligned with aperture 95 and through which the pole member 85 would be extended. The plate 97 can be provided with apertures 99 and the brace members 16 and 18 with aligned apertures 99' to be used to attach the plate 97 to the brace members 16 and 18. The embodiment of FIG. 10 does not provide for the use of the pole member 85, and of course, the use of such pole member 85 with the present invention is optional.

The configuration of the table top structure 11 may be circular, rectangular, square, or octagonal as is shown in the drawing. Obvious modifications and changes to the embodiments described herein in connection with the drawing, may be made by the skilled practitioner of the pertinent art without departing from the novel features of the present invention. For example, the lengths of the various brace members 16, 18, 16' and 18' can be selected in order to provide suitable framing upon which to mount an integrated table top structure of top members 12 and 14 presenting a rectangular configuration as well as an octagonal configuration. The table support structure 13 could be varied to accommodate an elongated rectangular table top configuration by providing repeating sets of leg members 31 disposed parallel with each other and joined together at top and bottom sections in a similar manner as has been set forth in connection with embodiments shown in FIG. 4 and FIG. 5, except that some obvious variation in perpendicular bracing would have to be employed.

Other alternative and equally useful and/or equivalent configurations and embodiments could no doubt be thought of and/or utilized to accomplish the intent and purpose of the present invention. It is to be understood that while the present invention has been shown and described with reference to the preferred embodiments thereof, the invention is not so limited to the precise forms and configurations set forth, and that some modifications and changes may be made therein without departing from the true spirit and scope of the present invention.

What is claimed is:

1. An improved table structure comprised in combination of table top means including in assembly a plurality of first brace members disposed with respect to each other in parallel spaced relationship, a plurality of second brace members disposed in parallel spaced relationship and extending perpendicular to and intersecting with selected ones of the first brace members, the top surface portions of each of the first and second brace members being disposed in the same plane to provide coplanar disposition thereof, a plurality of table top members being spaced apart from each other and attached to the first and second brace members at the intersecting locations therebetween, the top surfaces of the plurality of table top members being coplanar with each other, table top support means including in assembly a plurality of leg members, a plurality of first upper support members disposed in parallel spaced relationship, a plurality of second upper support members disposed in parallel spaced relationship and extending perpendicular to and intersecting with selected ones of the first upper support members, the top surface portions thereof being disposed coplanar with the top surface portions of the first upper support members, the ends of the first and second upper support members being attached to pairs of the leg members, respectively, first lower support members extending between and attachable to separated leg members, second lower support members extending between and attachable to other separated leg members, the second lower support members extending perpendicular to and intersecting with the first lower support members, foldable seating means pivotably attachable to selected ones of the leg members generally at the intersection between the leg member and either the first and second lower support members, respectively, the seating means including in assembly a seat member and a pair of extension arm members spaced apart and enclosing the leg member therebetween, and the extension arm members embracing therebetween both the leg member and the connecting lower support member at the location of intersection therebetween with the seat member moved to an extended position with respect to the leg member, and the extension arm members embracing therebetween principally only the attached leg member with the seat member moved to a non-extended folded position with respect to the leg member.

2. The improved table structure of claim 1 wherein the separated table top members define openings therebetween which extend through the table top structure and are of a size determined by the separations between the table top members.

3. The improved table structure of claim 1 wherein a pair of oppositely spaced leg members are connected to a pair of first upper support members and a first lower support member, and another pair of oppositely spaced leg members are connected to a pair of second upper support members and a second lower support member, and the length dimensions of the first and second upper support members are equal and the length dimensions of the first and second lower support members are equal and greater than the length dimensions of the first and second upper support members whereby the leg members are caused to extend angularly upward in a converging direction.

4. The improved table structure of claim 3 wherein the leg members are interleaved between the connected pairs of first and second upper support members and supported thereby to prevent movement about the elongated axes thereof, respectively.

5. The improved table structure of claim 3 wherein the leg members are provided with offset upper planar surfaces providing an uppermost planar surface and a lowermost planar surface thereof defining an inwardly facing shoulder surface therebetween, the lowermost planar surface provided to be coplanar with the coplanar top surface portions of the first and second upper support members, and the table top means provided to rest on the combined coplanar surfaces of the leg members, the first upper support members and the second upper support members with selected ones of the first and second brace members of the assembled table top means to be engaged by the inwardly facing shoulder surfaces to prevent horizontal displacement of the assembled table top means.

6. The improved table top structure of claim 1 wherein the seat member of the seating means is to be attached to the free end portion of the pivotable extension arm members, and arresting means is to be attached to the opposite end thereof, the arresting means having a first stop surface angled to extend in a plane parallel to the plane within which the surface of the seat member extends, the first stop surface moving into abutment with the connected lower support member with the free end portion fully extended for seating purposes.

7. The improved table top structure of claim 6 wherein the arresting means is provided with a second stop surface angled to extend in a plane lying parallel with the elongated axis of the upwardly extending leg member with the seat member and extension arm members folded inwardly toward engagement of the seat member with the leg member.

8. The improved table top structure of claim 7 wherein the seat member is provided with a recessed channel portion in the inwardly facing edge portion thereof, and the aligned edge portion of the leg member is received within the recessed channel with the seating means moved to the fully inwardly folded position thereof with respect to the leg member.

9. The improved table structure of claim 1 wherein pole means are provided for vertical extension through and above the table structure, and a centered one of the table top members is provided with a central opening extending therethrough, and block-like holder means are provided to engage the first and second lower support members at the location of intersection therebetween, the holder means having oppositely and perpendicularly intersecting channels in a lowermost section thereof which channels open into communication with each other and define four quadrantly located tine members extending downwardly in parallel spaced-apart relationship, the first and second lower support members are insertedly received into the communicating channels and the tine members are telescopically received over the first and second lower support members at the corners of the intersection therebetween to provide seating engagement of the holder means upon the first and second lower support members at the intersection thereof, and the holder means further includes an upper centered aperture aligned with the central opening through the table top member whereby the pole means may be extended through the table top structure downwardly and into the aligned upper aperture of the holder means.

10. An improved table structure including in combination, separable table top means having a coplanar top surface thereof, separable table top support means having support members arranged in intersecting coupled assembly, and including at least two pairs of oppositely disposed and spaced apart leg members connected to the support members, the pairs of leg members being disposed in perpendicularly intersecting vertical planes and extending angularly upward in a converging direction from the lower extremities thereof to the upper extremities thereof, whereby stability is provided for the table top support means, the leg members having raised upper surfaces thereof, respectively, defining inwardly facing shoulder portions, the table top means being mounted to rest upon the support members of the table top support means and engageable by the inwardly facing shoulder portions for restraining the table top means against horizontal movement, movable seating means pivotably connected to the leg members, respectively, and being moved between a retracted position lying adjacent to the connecting leg member, and an extended position lying outwardly of the connecting leg member, each of the seating means including a pair of elongated parallel spaced extension members, a seat member to be attached to the free end portion of the extension members with respect to the extended position thereof, and stop means attached to the oppositely disposed end portion to the free end portion thereof, and being moved into engagement with the connected leg member with the seating means moved to the fully retracted position thereof, and engaging a selected support member of the table top support means with the seating means moved to the fully extended position thereof, whereby the seat member is provided to lie in a plane extending parallel with the plane of the coplanar top surface of the table top means.

11. The improved table structure of claim 10 wherein the table top support members include upper support members extending between and attaching to the two pairs of spaced apart leg members, and selected top surfaces of the upper support members are provided to be coplanar and level with respect to each other, and to lie in a plane disposed in parallel relationship to the plane of the table top surface, and the table top means is mounted to rest upon the selected coplanar top surfaces of the upper support members.

12. The improved table structure of claim 11 wherein a pair of upper support members are arranged in parallel spaced relationship to extend between and be attached to each pair of spaced apart leg members, respectively, the leg members being enclosed between the opposite end portions of the spaced pairs of upper support members, respectively, and the upper support members extending in perpendicularly intersecting directions and providing top support surfaces disposed in the same plane to provide the coplanar top surfaces thereof.

13. The improved table structure of claim 10 wherein the extension members enclose therebetween principally only the leg member to which the extension members are pivotable attached with the seating means moved to the fully retracted position thereof, and the extension members enclose therebetween the leg member and a majority portion of the connecting support member at the location of connection therebetween for providing stability to the connection therebetween with the seating means fully extended.

14. An improved table structure including in combination table top means including a plurality of separable top members being mounted to provide separations therebetween and with the top surfaces thereof to be disposed in a common horizonal plane for providing a coplanar and level combined top surface, table top brace means including in assembly first and second brace members being disposed in parallel space and coplanar relationship, respectively, the second brace members extending perpendicular to and intersecting with the first brace members to provide a plurality of intersections therebetween, selected ones of the table top members being mounted to both the first and second brace members and generally centered for support over the intersections therebetween, table top support means including in assembly leg members and support members, the support members supporting the table top brace means and the leg members being connected to the support members and supported to extend angularly upwardly in a direction of convergence with the upwardly extended center line of the table structure, movable seating means pivotably connected to selected leg members and being moved between a first position disposed to lie adjacent to and to extend in the general direction of extension of the connected leg member, and a second position disposed to be removed from and to extend in a direction generally perpendicular to the direction of extension of the connected leg member.

15. The improved table structure of claim 14 wherein the leg members are provided with inwardly facing shoulder portions approximate to the upper extremities thereof, respectively, and the table top brace means are aligned to be engaged thereby for restraining the table top means against horizontal movement.

16. The improved table structure of claim 15 wherein the support members include upper pairs of support members spaced apart in parallel extension at least at the end portions thereof, said end portions being connected to a selected leg members and enclosing the leg member between the spaced end portions for preventing movement of the leg member about its elongated axis.

17. The improved table structure of claim 16 wherein the support members further include lower support members connected to the leg member, and the seating means include elongated parallel spaced extension arm members which are pivotably connected to the selected leg member, and which enclose therebetween principally only the leg member with the seating means in the first position thereof, and which enclosed therebetween both the leg member and a predetermined portion of the connected lower support member with the seating means in the second position thereof for thereby reinforcing the connection between the leg member and the lower support member.

* * * * *